US006123450A

United States Patent [19]

Bach

[11] Patent Number: 6,123,450

[45] Date of Patent: Sep. 26, 2000

[54] DECORATIVE ELEMENT, IN PARTICULAR AN ELEMENT FORMING A PART OF A TIMEPIECE

[75] Inventor: Michael Bach, Biel, Switzerland

[73] Assignee: Montres Rado SA, Lengnau, Switzerland

[21] Appl. No.: 08/966,481

[22] Filed: Nov. 7, 1997

[30] Foreign Application Priority Data

Nov. 22, 1996 [EP] European Pat. Off. ..... 96118796

[51] Int. Cl.[7] ..... G04B 37/00

[52] U.S. Cl. ..... 368/280; 368/281; 368/286; 368/285

[58] Field of Search ..... 368/223–239, 368/280, 281, 282, 285, 286

[56] References Cited

U.S. PATENT DOCUMENTS

| | | | |
|---|---|---|---|
| 5,491,028 | 2/1996 | Sarin et al. | 428/408 |
| 5,650,059 | 7/1997 | Shumaker et al. | 205/640 |
| 5,713,133 | 2/1998 | Bhat et al. | 30/350 |

FOREIGN PATENT DOCUMENTS

| | | |
|---|---|---|
| 3706818 | 9/1997 | Germany . |
| 296274 | 4/1954 | Switzerland . |
| WO8503364 | 8/1985 | WIPO . |

OTHER PUBLICATIONS

The Role of Hydrogen in Diamond Synthesis from Carbon Dioxide–hydrocarbon Gases by Microwave Plasma Chemical Vapor Deposition, *Surface and Coatings Technology,* vol. 54/55, 1992, Switzerland, pp. 368–373 Chen et al.

Friction and Wear Behavior of Diamond Films Against Steel and Ceramics, *Wear,* vol. 169, No. 2, Oct. 15, 1993, pp. 221–229, Gangopadhyay et al.

Preparation and Characterization of Boron Rich Boron Nitride Microcrystals . . . , *Journal of Chemical Vapor Deposition,* vol. 1, No. 1, Jul. 1992, pp. 59–72, Saitoh et al.

Electron Microscopy and ESCA Studies of Niobium Films Sputter Deposited on Stainless Steel, *Electron Microscopy Society of Southern Africa, 15th Ann. Conference,* vol. 6, Dec. 1976, pp. 99–100, Copperthwaite et al.

*Primary Examiner*—Bernard Roskoski

*Attorney, Agent, or Firm*—Sughrue, Mion, Zinn, Macpeak & Seas, PLLC

[57] ABSTRACT

The invention concerns a decorative element which includes a substrate coated at least partially with a protective decorative film made of a hard material, characterised in that the material of said film has a microcrystalline structure and an external surface having a regular cauliflower type topography.

11 Claims, 2 Drawing Sheets

DECORATIVE ELEMENT, IN PARTICULAR AN ELEMENT FORMING A PART OF A TIMEPIECE

The present invention concerns a decorative element comprising a surface coated with a protective decorative film made of a hard material, and more particularly an element forming part of a timepiece case or wristlet, said element having an external surface coated with a film of hard, smooth material which may, if necessary, be polished without excessive difficulty.

Patent EP-A-0 199 207 already disclosed making decorative elements forming parts of a timepiece, such as a watch case, said parts having external visible surface portions, which are liable to come into contact with foreign bodies, for example the upper surfaces of the case, have an unchangeable aspect, i.e. they can neither be scratched upon contact with such foreign bodies, nor can they become oxidised or tarnished upon contact with air, so that it is possible for these parts of the case to be given a fine and well finished appearance. In order to achieve this aim, the aforecited Patent proposes the use of metal carbide platelets (tungsten carbide or titanium carbide) coated with a film of polycrystalline diamond typically having a thickness of between 0.4 and 0.8 mm, these platelets being added onto the watch case by bonding or welding.

The platelets are obtained from discs of a maximum diameter equal to 51 mm. The manufacture of such discs requires the use of the equivalent of approximately 4000 diamonds of 1 mm size, i.e. equivalent to 16.5 carats. These diamonds are first ground into powder and the powder is sintered at approximately 1,500° C. at a pressure of the order of 5,000 MPa on a hard metal substrate (metal carbide). The discs are then sandblasted and smoothed using an electric discharge process, and finally polished during a long polishing process using diamond grinding wheels. Next the discs are carefully selected, in particular when such discs are intended to be used as elements or parts of wristwatches, in order to check the thickness and exterior appearance, in particular the homogeneity of the colour of the diamond film. The discs obtained are then machined, using known methods, such as electro-erosion machining or laser machining, into their final shape to obtain the desired platelet or ring. Finally the sharp edges of the platelet are removed during a final chamfering operation using a diamond grinding wheel.

The production of these platelets has numerous drawbacks.

The quantity of diamond powder and the quantity of energy necessary to transform the powder by sintering to polish the diamond film obtained, and to machine and chamfer the disc in order to obtain a finished platelet are such that the cost price of the disc is very high and result in a prohibitive increase in the cost of the products in which such platelets are used.

Another drawback of this method is that it is not possible to obtain discs of exactly the same colour, so that the platelets used for a same wristwatch must come from a same disc. This thus practically limits the use of such discs to producing watch bezels or platelets in conformity with what is shown in FIGS. 2 and 3 of Patent EP-A-0 199 207.

Moreover, this method requires the use of a hard sintered metal substrate comprising cobalt as binder for reasons of adherence to the diamond powder. The presence of cobalt as binder in the substrates makes the latter easily able to oxidise, which requires the deposition of a protective film on the substrate and further increases the cost price of the disc.

Moreover, by its nature, this method of forming a diamond film by compression and sintering is limited to producing platelets with a flat surface and of relatively simple geometrical shapes.

Other methods for coating substrates with films of hard materials have already been envisaged. In particular, a chemical vapor deposition method for depositing a film of diamond on a substrate to obtain cutting tools is known from Patent Document U.S. Pat. No. 4,734,339. The topography of the diamond films obtained using this method is rough and irregular, so that these films act as a file on the commonly used materials with which they may come into contact. Moreover, its aspect is without brilliance.

The topography of the film obtained according to this method has a multitude of diamond microcrystals having dimensions of the order of 5 um, of parallelepiped shape with extremely hard edges (of the order of 10,000 Vickers) which are extremely resistant to wear. This hardness and this high resistance to wear are due to the quasi exclusive presence of the SP3 type bonds between the carbon atoms which form the diamond film. The multitude of well defined edges at the surface of these diamond films thus form a multitude of anchoring points for a material which is rubbed onto it. A scratch from a commonly used material, i.e. a soft material with respect to the diamond, leaves visible traces on the surface of the hard film, which cannot be completely removed, for example using simple means, such as a damp cloth, readily available to all consumers.

It is thus easily understood that the use of such hard films with a decorative object such as a watch case or wristlet cannot be envisaged. Indeed, it is not acceptable for a consumer believing he has purchased a "scratchproof" item to see marks left on his or her item by a scratch from another softer material.

This drawback may be reduced without being removed by effecting polishing of the film obtained. However, polishing of such films is long and expensive to the extent that the edges to be removed are the hardest part of the film. The removal of the edges to obtain a more regular topography by polishing is an economically prohibitive operation and consequently unrealistic.

It will be noted in this regard that polishing of such a faceted surface is contrary to the desired purpose for an application of the diamond film to cutting tools for which it is desirable to increase the abrasion of the film as much as possible. This, of course, goes against the making of a surface having a type of topography which can easily be polished which could be applied to the manufacture of a decorative element.

An object of the invention is thus to overcome the drawbacks of the aforementioned prior art by providing a decorative element, particularly an element forming part of a timepiece, comprising a superficial film made of a very hard material having a microcrystalline structure which has a regular topography and which is not abrasive.

Thus the invention concerns a decorative element comprising a substrate coated at least partially with a protective and decorative hard material, characterised in that the hard material forming said film has a microcrystalline structure and an external surface having a regular topography of the cauliflower type.

The particular topography (called the cauliflower type) of the hard film has the advantage of having neither sharp edges nor deeps hollows, even prior to polishing of such film. The marks left by deposits of softer material at the surface of the coating following scratching may thus easily be diminished or removed by simple means, such as a cloth or a finger, available to any consumer. It will be noted that such coatings may advantageously be used unpolished without fear of marking in a quasi indelible manner the surface of the coating as was the case in the prior art.

According to a preferred feature of the invention, the film of hard material is mirror polished.

According to another preferred feature of the invention, the hard material is diamond or boron nitride having a cubic structure.

By using cauliflower type diamond for coating said elements, the superficial hardness of the coated surfaces is of the order of 8,000 Vickers, which leads to an abrasion resistance four times higher than that of diamond coatings of the prior art which have hardnesses of the order of 6,000 to 8,000 Vickers Other features and advantages of the invention will appear more clearly upon reading the following description of an embodiment of the invention, given purely by way of illustrative and non limiting example, this description being made in conjunction with the drawings in which.

Figure 1:
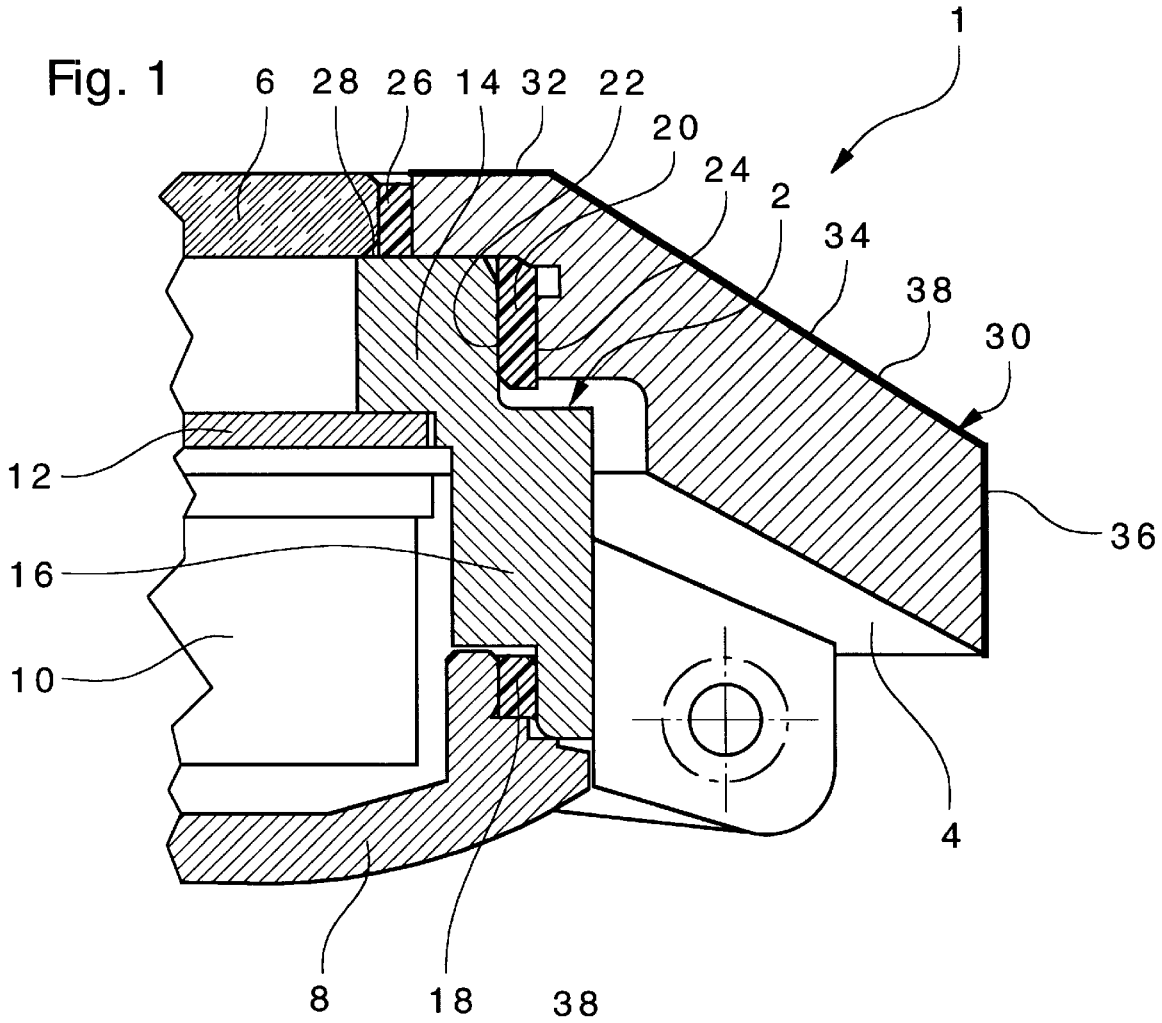
FIG. 1 is a partial cross-section of a wristwatch fitted with a decorative element according to the invention.

A decorative element according to the invention will now be described in detail within the framework of an application to the manufacture of an element forming part of a timepiece and more particularly a bezel of a wristwatch shown in FIG. 1 and designated by the general numerical reference 1.

Wristwatch 1 comprises four main parts: an internal middle part 2, a bezel 4, a crystal 6 and a back cover 8. Internal middle part 2 and bezel 4 have shapes which are determined in such a way that manufacturing operations are simplified and assembly operations are facilitated.

Internal middle part 2 is made of a metal which can easily be machined, for example of stainless steel. Middle part 2 which is intended to contain a movement 10 on which a dial 12 is mounted includes an upper portion 14 and a lower portion 16. Lower portion 16 surrounds and carries movement 10 and dial 12 in a conventional manner which will not therefore be described here in more detail. Back cover 8 is also fixed to lower portion 16 in a conventional manner via a sealing gasket 18.

Middle part 2 is fixed to bezel 4 by a ring 20 made of a material able to be deformed engaged in a radial spacing provided between facing coaxial cylindrical surfaces 22, 24 of middle part 2 and bezel 4 respectively.

Crystal 6 is fixed in the opening of bezel 4 by means of a sealing gasket 26 and abuts against upper face 28 of internal middle part 2.

The external surface 30 of bezel 4, which, in the embodiment example described, is the surface to be coated with a hard material, includes a first face 32 parallel to the plane of the dial. Face 32 is extended by a second truncated face 34, then by a third lateral circular face 36 which is perpendicular to the plane of the dial.

Faces 32, 34 and 36 of the bezel are coated according to the invention with a thin film 38 of very hard material such as a diamond or boron nitride film. Film 38 typically has a thickness of between 1 and 20 micrometers and a hardness of the order of 8,000 to 10,000 Vickers.

A method for making an element forming part of a timepiece according to the invention, such as bezel 4, on which a diamond film having a microcrystalline structure and a cauliflower type surface topography will be deposited, will now be described.

In order to do this, a substrate having the surface or surfaces which one desires to coat in their finished shape are first provided. In the example described these are faces 32, 34 and 36 of bezel 4.

By "finished shape" one means that the surfaces have thus been prepared by conventional shaping or machining techniques into their final shape for use. These shaping or machining techniques are of course suited to the material of which the substrate is made.

The substrate preferably has a hardness greater than 800 Vickers, and typically a sintered hard metal or ceramic substrate is appropriate. If the substrate material is too soft, a shock to thin film 38 will result in deformation of the substrate and in most cases a crack in film 38, given its poor elastic properties.

In the event that a hard metal substrate is desired, a stainless hard metal such as a tungsten carbide or titanium carbide based sintered hard metal will preferably be chosen, these carbides being bound by metal binders such as nickel, chromium, cobalt or molybdenum or a mixture of these latter.

In order to increase adhesion to the hard film to be deposited, the surfaces to be coated undergo surface treatment in order to reduce the concentration of binder at the surface (over approximately several tens of micrometers). By way of example, this surface treatment may consist of a heat treatment in a vacuum during which the binder at the surface evaporates, or a chemical treatment in a solution of $H_2SO_4/H_2O_2$ at a respective concentration of 5% and 35%.

In the event that a ceramic substrate is desired, carbide or nitride based ceramic materials having high shock resistance will preferably be chosen. For example silicon carbide and/or silicon nitride based ceramic materials are suitable.

Oxide based ceramic substrates may also be used, however a prior treatment allowing a carbide to be obtained at the surface which has to be coated is necessary. By way of example, this treatment may consist of a heat treatment in a controlled atmosphere, a chemical or plasma treatment.

Once the substrate has been prepared, it is placed in the chamber of a chemical vapor deposition installation, the substrate being arranged on a suitable support means for carrying out the deposition of a diamond film and obtaining a film having a cauliflower type topography or structure. A method allowing such a film to be obtained is described in detail in the publication entitled "The role of hydrogen in diamond synthesis from carbon dioxide-hydrocarbon gases by microwave plasma chemical vapor deposition" by Chia-Fu Chen and Tsao-Ming Hong, published in 1992 in the review Surface and Coatings Technology 54/55, pages 368 to 373, which is incorporated here in its entirety by reference. It is understood that any other method allowing films of hard material having a cauliflower type structure or topography to be deposited on a substrate may be envisaged.

Figure 4:
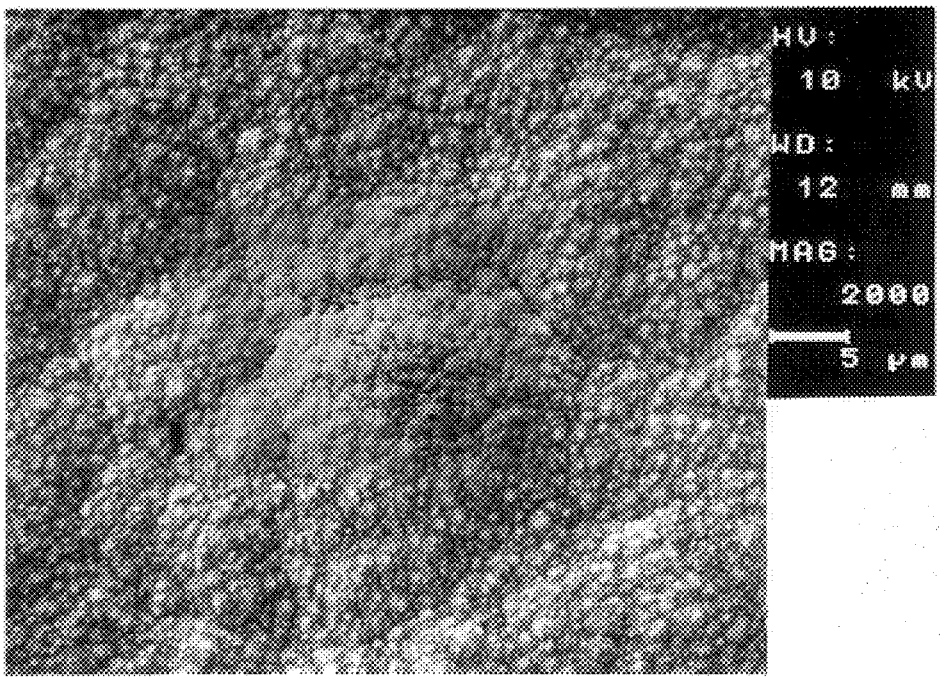

The surface of the diamond film obtained has a topography comprising a cluster of microglobules, as is seen in FIG. 4 which shows a micrograph of the surface of a cauliflower type diamond film with a magnification×2,000. Whereas in faceted type diamond films, the bonds between the carbon atoms are almost exclusively of the SP3 type and have a hardness of approximately 10,000 Vickers, the cauliflower type diamond films used in the decorative element according to the invention comprise a high proportion of carbon atoms bonded by bonds of the SP2 type with a small proportion of SP3 type bonds and have a hardness of the order of 8,000 Vickers. This mixture of SP3 and SP2 type carbon-carbon bonds is in fact a defect which appears when the diamond film is grown from the surface of the substrate and which results in a smooth microglobular structure such as that shown in FIG. 4.

Figure 3:
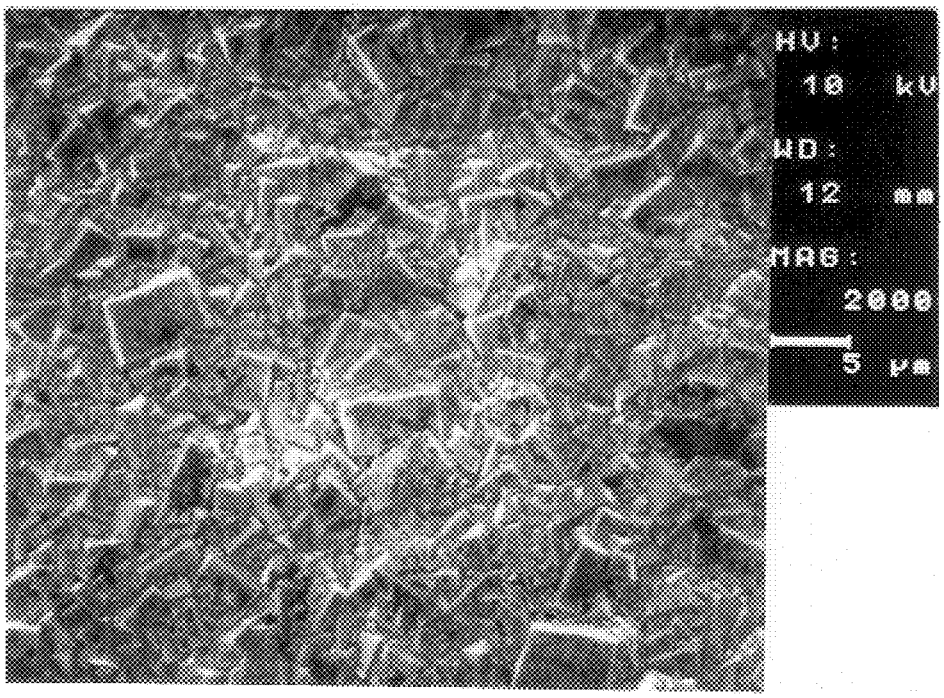
FIGS. 3 and 4 are micrographs of diamond films, respectively of the faceted and cauliflower types.

Conversely, the CVD grown diamond films disclosed in Patent Document U.S. Pat. No. 4,734,339, have a topography which comprises a multitude of sharp edges and deep hollows arranged in a random manner as is visible in FIG. 3 which shows a micrograph of the surface of a faceted type diamond film with a magnification×2,000.

The cauliflower type film thus has a prime advantage for use on an element forming part of a timepiece, namely that the hard film may be mirror polished using a diamond grinding wheel without excessive difficulty.

Of course, in the event that one does not wish all the faces of the substrate to be coated with a hard material, a mask may be provided which protects the faces on which no material is to be deposited.

Figure 2:
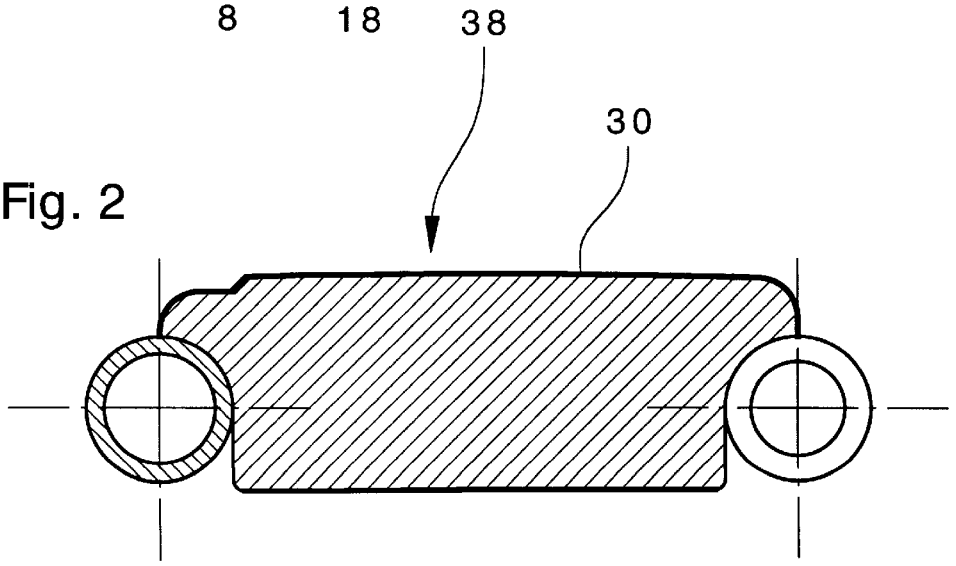
FIG. 2 is a cross-section of another decorative element according to the invention in the form of a link of a wristlet which can be used with the wristwatch shown in FIG. 1.

It goes without saying that the decorative element according to the invention is not limited to producing an element forming part of a timepiece described hereinbefore and that other decorative elements such as a wristlet link 38 which is shown in FIG. 2 may be envisaged.

What is claimed is:

1. A decorative element comprising a substrate coated at least partially with a protective decorative film made of a hard material, wherein the hard material forming said film has a microcrystalline structure and an external surface having a regular cauliflower type topography wherein said element forms part of a timepiece.

2. A decorative element according to claim 1, wherein the film of hard material is mirror polished.

3. A decorative element according to claim 1, wherein said hard material is diamond.

4. A decorative element according to claim 1, wherein said hard material is boron nitride having a cubic structure.

5. A decorative element according to claim 1, wherein the substrate has a hardness greater than or equal to 800 Vickers.

6. A decorative element according to claim 1, wherein the substrate is made of a hard stainless metal.

7. A decorative element according to claim 1, wherein the substrate is made by sintering a mixture of a hard metal and a binder.

8. A decorative element according to claim 1, wherein the substrate is made of a ceramic material.

9. A decorative element according to claim 8, wherein said ceramic material is silicon nitride or silicon carbide.

10. A decorative element according to claim 1, wherein said element is a middle part-bezel intended for use in a watch case.

11. A decorative element according to claim 1, herein said element includes a wristlet link.

* * * * *